US010493340B1

(12) United States Patent
Golden et al.

(10) Patent No.: US 10,493,340 B1
(45) Date of Patent: Dec. 3, 2019

(54) WEDGE GOLF CLUB FITTING SYSTEM

(71) Applicant: Acushnet Company, Fairhaven, MA (US)

(72) Inventors: Charles E. Golden, Encinitas, CA (US); Kevin Tassistro, San Marcos, CA (US); John Morin, The Woodlands, TX (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/170,506

(22) Filed: Oct. 25, 2018

(51) Int. Cl.
*A63B 53/00* (2015.01)
*A63B 60/46* (2015.01)
*A63B 53/04* (2015.01)

(52) U.S. Cl.
CPC ..... *A63B 60/46* (2015.10); *A63B 53/047* (2013.01); *A63B 2053/0479* (2013.01); *A63B 2220/34* (2013.01); *A63B 2220/40* (2013.01); *A63B 2220/53* (2013.01); *A63B 2220/833* (2013.01); *A63B 2225/50* (2013.01)

(58) Field of Classification Search
CPC . A63B 60/46; A63B 53/047; A63B 2220/833; A63B 2220/34; A63B 2220/40; A63B 2220/53; A63B 2053/0479; A63B 2225/50
See application file for complete search history.

(56) References Cited

U.S. PATENT DOCUMENTS 5,351,952 A * 10/1994 Hackman ..... A63B 69/3632 473/409
5,441,256 A * 8/1995 Hackman ..... A63B 53/00 473/409
5,478,073 A * 12/1995 Hackman ..... A63B 69/3632 473/289
6,375,579 B1 * 4/2002 Hart ..... A63B 69/3614 473/131
8,784,228 B2 * 7/2014 Morin ..... A63B 69/36 473/219
2002/0123386 A1 * 9/2002 Perlmutter ..... A63B 24/0021 473/223
2003/0216191 A1 * 11/2003 Wright ..... A63B 53/0487 473/288
2004/0048685 A1 * 3/2004 Tsunoda ..... A63B 53/04 473/345
2006/0052173 A1 * 3/2006 Telford ..... A63B 24/0003 473/131
2008/0115582 A1 * 5/2008 Sato ..... A63B 69/3632 73/649
2009/0131190 A1 * 5/2009 Kimber ..... A63B 69/3632 473/222
2009/0326688 A1 * 12/2009 Thomas ..... A63B 69/3623 700/91
2010/0216563 A1 * 8/2010 Stites ..... A63B 69/3614 473/223

(Continued)

*Primary Examiner* — Stephen L Blau

(57) ABSTRACT

A system and methods of fitting golf clubs, and more particularly, the systems and methods related to wedge type golf clubs, having multiple sole configurations and/or bounce angles. More specifically, the present invention is directed to system and methods that enable a player to quantify the performance of the golf club's sole interaction with the ground and to determine the sole configuration and bounce angle that provides the most optimal shot performance.

11 Claims, 9 Drawing Sheets

(56) References Cited

U.S. PATENT DOCUMENTS

| | | | | |
|---|---|---|---|---|
| 2012/0050529 | A1* | 3/2012 | Bentley | G01S 19/19 348/139 |
| 2012/0277035 | A1* | 11/2012 | Ueda | G01N 29/045 473/409 |
| 2014/0045604 | A1* | 2/2014 | Brunski | A63B 55/40 473/288 |
| 2014/0260636 | A1* | 9/2014 | Kammerer | G01H 3/04 73/646 |
| 2015/0367222 | A1* | 12/2015 | Ripp | G06Q 30/0621 473/221 |
| 2016/0184632 | A1* | 6/2016 | Ueda | A63B 69/36 |
| 2016/0332049 | A1* | 11/2016 | Stites | A63B 69/36 |
| 2017/0274256 | A1* | 9/2017 | Brekke | G01S 19/19 |
| 2017/0291064 | A1* | 10/2017 | Onuki | A63B 69/3617 |
| 2017/0340936 | A1* | 11/2017 | Hanamitsu | G01B 5/0023 |
| 2018/0272186 | A1* | 9/2018 | Goel | G06K 9/00342 |

* cited by examiner

WEDGE GOLF CLUB FITTING SYSTEM

TECHNICAL FIELD

The present technology generally relates to systems, devices, and methods related to golf clubs, and more specifically to fitting wedge type golf clubs having different sole configurations.

DESCRIPTION OF THE RELATED TECHNOLOGY

Wedge type golf clubs have generally been considered to be some of the most essential equipment in the game of golf. Progressing in parallel with the development of the game of golf, significant developments have occurred within the golf equipment industry. Golf clubs have also developed simultaneously with all other types of golf equipment to accommodate for the needs of the golfer to hit their shots more accurately and with more control.

Iron type golf clubs include both conventional iron clubs as well as wedges. Each golf club includes a shaft with a club head attached to the distal end of the shaft and a grip attached to the proximal end of the shaft. The club head includes a face for striking a golf ball. In general, the greater the loft of the golf club in a set, the greater the launch angle and the less distance the golf ball is hit. A set of conventional irons generally includes individual irons that are designated as number 3 through number 9, and a pitching wedge. The conventional iron set is generally complimented by a series of wedges, such as a lob wedge, a gap wedge, and/or a sand wedge. Each iron type golf club has a shaft length that usually decreases through the set as the set as the loft for each golf club head increases, from the long irons to the short irons and through the wedges. Additionally, iron type golf clubs generally include grooves running across the striking face from the heel towards the toe to increase the friction between the striking face and golf ball, inducing spin on the golf ball as the striking face impacts the golf ball.

Wedges are a particular type of iron type golf clubs that generally have higher loft angles. These higher lofted wedges tend to be precision instruments that allow a golfer to dial in short range golf shots with improved trajectory, improved accuracy, and improved control.

Several types of wedges are depicted in FIGS. 1-4. FIG. 1 depicts a Vokey™ gap wedge having 50° of loft and a F-grind sole with 8° of bounce. The F-grind sole is an all-purpose grind that is particularly suited for full shots and shots hit with a square face. The grind is generally preferred by players that desire a traditional wedge sole. The F-grind is the most played sand wedge sole on the PGA Tour. FIG. 2 depicts a Vokey™ sand wedge having 54° of loft and a M-grind sole with 8° of bounce. The M-grind is designed for players that like to rotate the club face open and closed to manufacture different shots around the green. The M-grind is generally better for players with a shallower, more sweeping swing that play shots from a variety of clubface positions. FIG. 3 depicts a Vokey™ sand wedge having 56° of loft and a S-grind sole with 10° of bounce. The S-grind sole is generally best for square faced shots, but has more versatility than the F-grind. It is a good grind for players that are mid to shallow in their club head delivery to the ball. FIG. 4 depicts a Vokey™ lob wedge having 58° of loft and a D-grind sole with 12° of bounce. The D-grind sole is generally preferred by players that have a steeper delivery to the ball because of the wedge's higher bounce. The D-grind is similar to the M-grind in that they have a crescent-shaped sole, but the D-grind offers more bounce. As is evident, there are numerous types of wedges with different sole grinds and multiple degrees of bounce. Thus, a system to accurately and efficiently assist players in being properly fit for the wedges that will assist them in scoring is greatly desired.

SUMMARY

The systems, methods, and devices described herein have innovative aspects, no single one of which is indispensable or solely responsible for their desirable attributes. Without limiting the scope of the claims, some of the advantageous features will now be summarized.

The present technology generally relates to a system and methods of fitting golf clubs, and more particularly, the systems and methods related to wedge type golf clubs, having multiple sole designs and bounce angles. More specifically, the present invention is directed to system and methods that enable a player to quantify the performance of the golf club's sole interaction with the ground and to determine the sole and bounce that provides the most optimal shot performance. By improving the club impact, the player will inherently improve ball flight as well as control around the green.

The invention herein is directed to a system of selecting the proper bounce and sole construction of a golf club head by measure impact forces and determining the efficiency of the sole-to-ground interaction during impact. An iron type golf club body, and more particularly wedge type iron, has a striking face on a forward portion of said body, that is configured to strike a golf ball, and a back surface of said body opposite said strike face. Extending from the strike face to the back wall on the bottom surface is a sole that also extends from a heel side of said body to a toe side of said body. The body also incorporates a top line on a top portion of said body and a hosel on the heel side of the body that is configured to receive a shaft. The sole of an iron or wedges type club head can be selected from a plurality of configurations and bounce angles of between about 5° and 20°.

The system of selecting the proper bounce and sole construction of a golf club head further comprises a sensor that can measure acceleration and rotational velocity data as a function of time during a golf swing. The sensor is coupled to a lower portion of the shaft or the back surface of said body and is in communication with a computer to provide the acceleration and rotational velocity data to said computer. The computer can determine the power spectrum of the sensor as a function of frequency so that the impact of the sole with a ground surface can be analyzed.

The system of selecting the proper bounce and sole construction of a golf club head by measuring ground impact according to the present invention preferably measures the power spectrum for a range of about 0 Hz to about 300 Hz. The preferred sole configuration and bounce angle can be determined by those clubs exhibiting a power spectrum at 50 Hz being at least two times greater than the power spectrum at all frequencies between 100 Hz and 300 Hz. In the preferred system, the computer calculates a power spectrum difference which is the difference between a first power spectrum at 50 Hz and second power spectrum that is the largest power spectrum between 100 Hz and 300 Hz. The club head that demonstrates the largest power spectrum difference calculated for multiple golf club heads is the club head which has the most efficient club-to-ground impact and will provide optimal shot making capability.

The system of selecting the proper bounce and sole construction of golf club head by measuring impact according to the present invention preferably measures the power spectrum of the sensor for a range of about 0 Hz to about 300 Hz. The preferred sole configuration and bounce angle can be determined by those clubs exhibiting a power spectrum at 50 Hz being at least five times greater than the power spectrum at all frequencies between 100 Hz and 300 Hz. In the preferred system, the computer calculates a power spectrum ratio which is the ratio between a first power spectrum at 50 Hz and second power spectrum that is the largest power spectrum between 100 Hz and 300 Hz. The club head that demonstrates the largest power spectrum ratio for multiple golf club heads is the club head that has the most efficient club-to-ground impact and will provide optimal shot making capability.

In yet another system of selecting the proper bounce and sole construction of golf club head by measuring impact according to the present invention preferably measures the power spectrum root mean square average ratio of the sensor for a frequency range of about 0 Hz to about 300 Hz. The preferred sole configuration and bounce angle can be determined by calculating a first power spectrum average RMS over a frequency range of 0 Hz to 100 Hz and a second power spectrum average RMS for a frequency range of 100 Hz to 300 Hz. The club head that demonstrates the largest power spectrum RMS average ratio over a preferred bandwidth, RMS (0-100 Hz)/RMS (100-300 Hz), for multiple golf club heads is the club head that has the most efficient club-to-ground impact and will provide optimal shot making capability. Preferably, the power spectrum RMS average ratio is greater than 1, and more preferably, greater than about 1.5.

The present invention is also directed to a method of fitting a golfer with a golf club having the proper bounce and sole construction of golf club head by measuring impact forces. The method includes providing a plurality of golf club heads, each of the club heads having a sole configuration and bounce angle combination, attaching a sensor to the golf club heads, having the golfer hit predetermined golf shots with the golf club heads, analyzing the power spectrum from about 0 Hz to about 300 Hz, measuring a first power spectrum data point at 50 Hz and a second power spectrum data point that is a maximum power spectrum between 100 Hz and 300 Hz, calculating a power spectrum difference for each club by subtracting the second power spectrum data point from the first power spectrum data point, and selecting a preferred club from the plurality of clubs that demonstrates the largest power spectrum difference.

The present invention is also directed to a method of fitting a golfer with a golf club having the proper bounce and golf club sole construction by measuring sole-to-ground impact forces. The method includes providing a plurality of golf club heads, each of the club heads having a sole configuration and bounce angle combination, attaching a sensor to the golf club heads, having the golfer hit predetermined golf shots with the golf club heads, recording the sensor's power spectrum from about 0 Hz to about 300 Hz, measuring a first power spectrum data point at 50 Hz and a second power spectrum data point that is a maximum power spectrum between 100 Hz and 300 Hz, calculating a power spectrum ratio for each club by dividing the first power spectrum data point by the second power spectrum data point, and selecting a preferred club from the plurality of clubs that demonstrates the largest power spectrum ratio.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
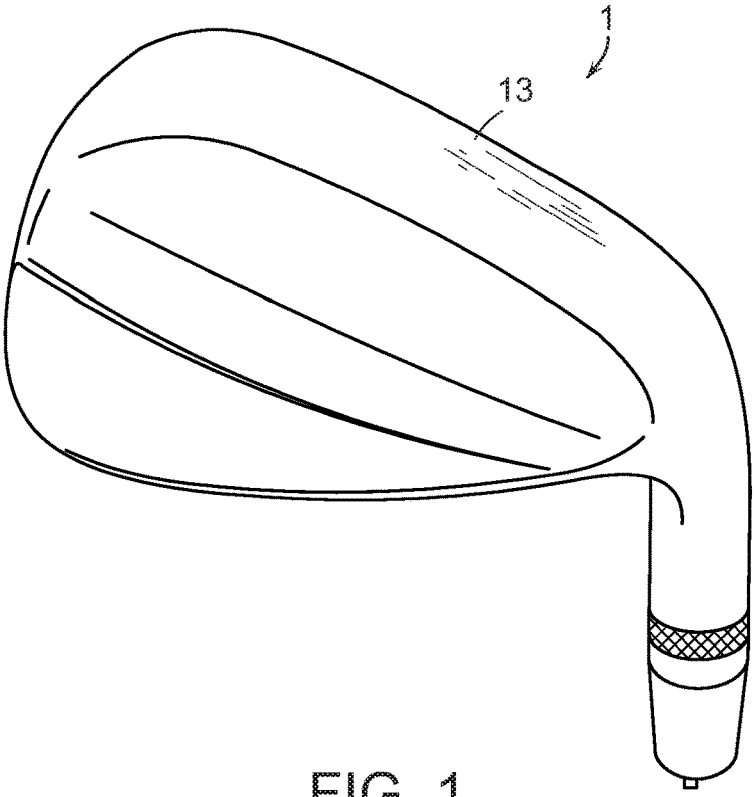
FIG. 1 illustrates a gap wedge having 50° of loft and a F-grind sole with 8° of bounce.
Figure 2:
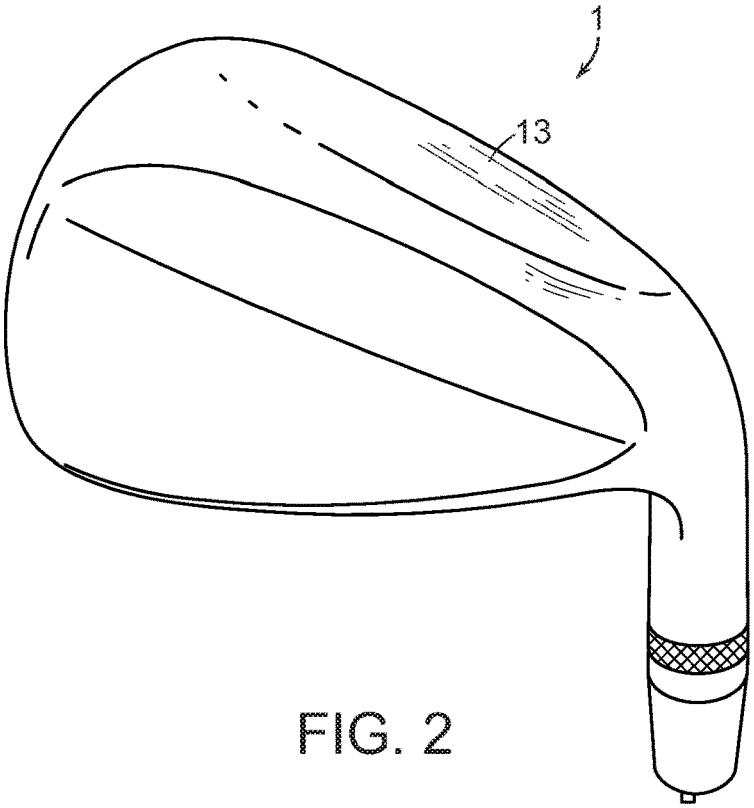
FIG. 2 illustrates a sand wedge having 54° of loft and a M-grind sole with 8° of bounce.
Figure 3:
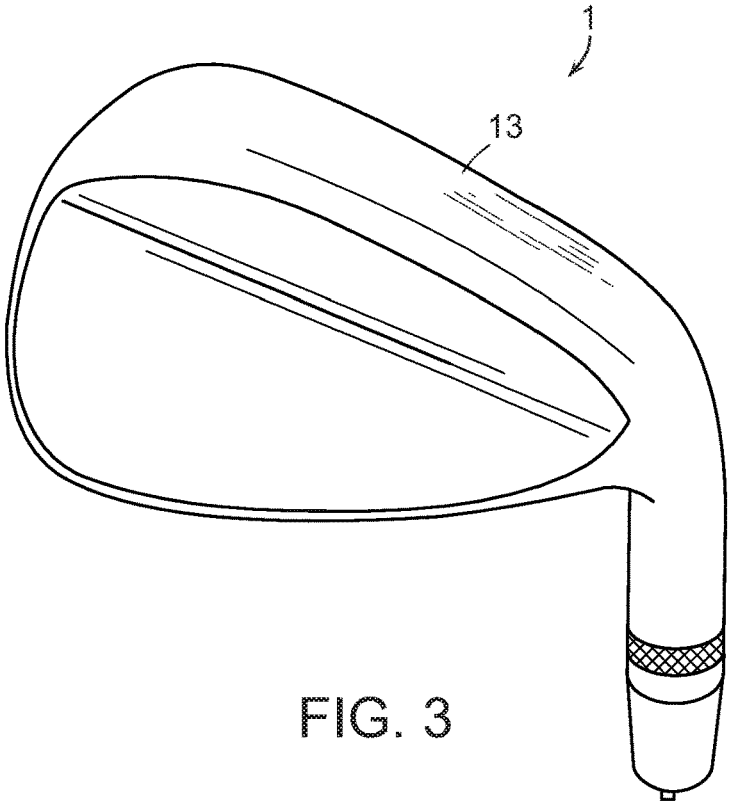
FIG. 3 illustrates a sand wedge having 56° of loft and a S-grind sole with 10° of bounce.
Figure 4:
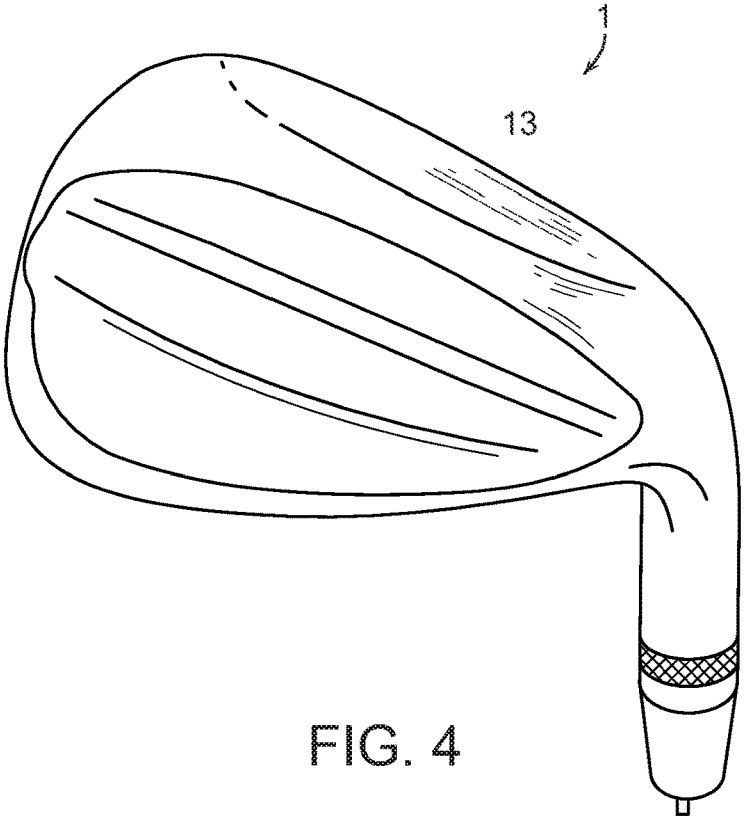
FIG. 4 illustrates lob wedge having 58° of loft and a D-grind sole with 12° of bounce.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and bounce angles, power spectrums, frequencies and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly, after reading the section entitled "Detailed Description" one will understand how the illustrated features serve to explain certain principles of the present disclosure.

The present invention is directed to a system and method of fitting golf club heads, and more particularly, improved systems and methods for fitting iron type club heads. Most preferably, the systems and methods herein are for fitting wedge type irons having lofts of 46° to 64° as exemplified in FIGS. 1-4 and discussed in reference with Table 1 below.

Figure 5:
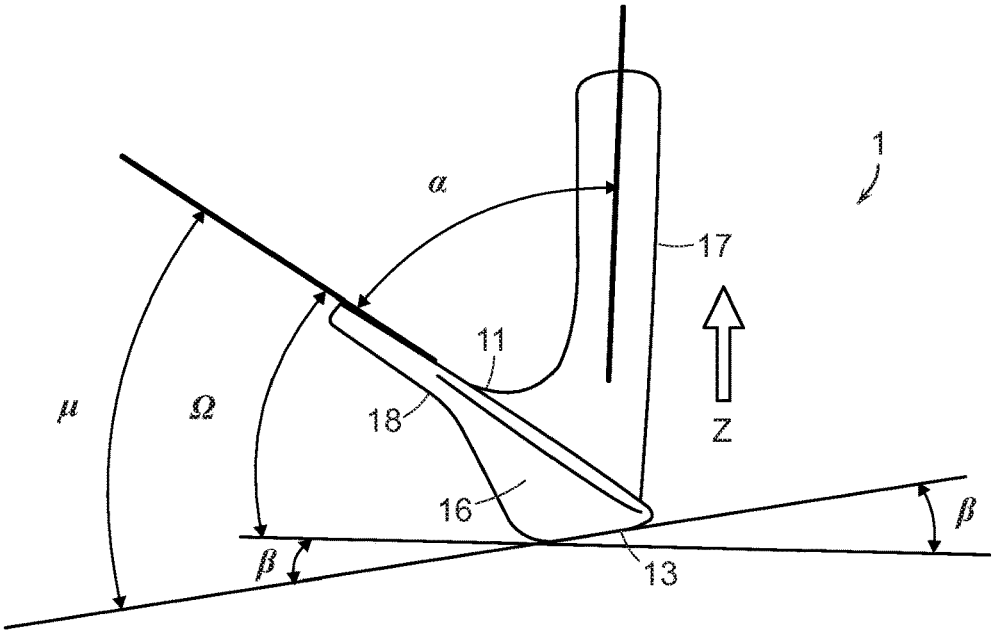
FIG. 5 is a toe view of a wedge.
Figure 6:
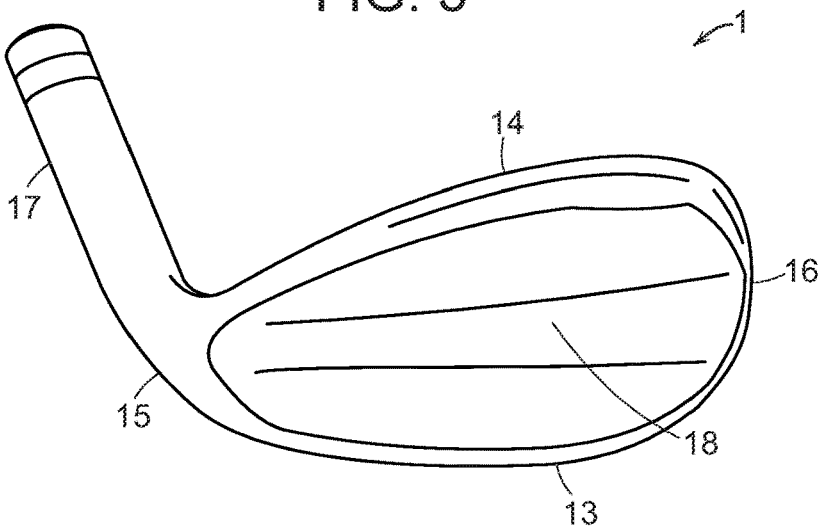
FIG. 6 is a back view of a wedge.
Figure 7:
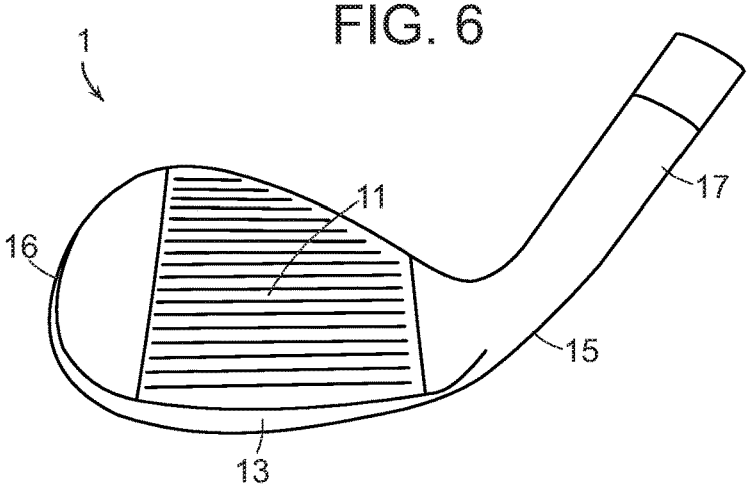
FIG. 7 is a front view of a wedge.

FIGS. 5-7 illustrate an iron type golf club head 1. An iron type golf club head 1, and more particularly wedge type iron, has a striking face 11 on a forward portion of said body that is configured to strike a golf ball, and a back surface 18 of said body opposite said strike face 11. Grooves are machined into the striking face 11 that extend from a toe end of the club head 1 to a heel end of the club head 1. Grooves are preferably radiused at the toe and heel portions of the club head 1. Preferably a round cutter or a saw cutter, is used to form the grooves such that the toe and heel portions are radiused about an axis of rotation that is perpendicular to a longitudinal axis of the groove. Having radiused grooves ends facilitates removal of dirt, grass, sand, and other materials that typically become embedded within the grooves of a golf club during normal use by eliminating corners that can trap these materials. Details about grooves and groove manufacture can be found in more detail in U.S. Pat. No. 7,758,449 to Gilbert, et al., hereby incorporated by reference in its entirety. Any definitions, terminology, or characterizations of the invention included herein shall take precedence over any conflicting information provided in any material incorporated by reference.

Extending from the strike face to the back wall on the bottom surface is a sole 13 that also extends from a heel side 15 of said body to a toe side 16 of said body. The body also incorporates a top line 14 on a top portion of said body and a hosel 17 on the heel side of the body that is configured to receive a shaft 19. The sole 13 of an iron or wedges type club head can be selected from a plurality of configurations and bounce angles of between about −5° and 20°. Examples of some available wedges are set forth in Table 1.

TABLE 1

| Wedge Type | Loft (α) | Bounce Angle (β) | Sole Configuration |
|---|---|---|---|
| Pitching | 46 | 10 | F |
| Pitching | 48 | 10 | F |
| Gap | 50 | 8 | F |
| Gap | 50 | 12 | F |
| Gap | 52 | 8 | F |
| Gap | 52 | 12 | F |
| Sand | 54 | 8 | M |
| Sand | 54 | 10 | S |
| Sand | 54 | 14 | F |
| Sand | 56 | 8 | M |
| Sand | 56 | 10 | S |
| Sand | 56 | 14 | F |
| Lob | 58 | 4 | L |
| Lob | 58 | 8 | M |
| Lob | 58 | 10 | S |
| Lob | 58 | 12 | D |
| Lob | 58 | 14 | K |
| Lob | 60 | 4 | L |
| Lob | 60 | 8 | M |
| Lob | 60 | 10 | S |
| Lob | 60 | 12 | D |
| Lob | 60 | 14 | K |
| Lob | 62 | 8 | M |

The loft a of a wedge, as shown in FIG. 5, generally determines the launch angle, and thus, the distance a golf ball is hit. For example, a wedge having a loft of 46° will hit a golf ball with a lower launch angle than a wedge having a 60° loft. A full shot with a wedge having a loft of 46° will also go substantially further than with a wedge having a 60° loft. Moreover, golfers generally use a plurality of wedges for their golf game. Pitching and gap wedges are often used for fuller shots into a green and more of a bump-and-run type pitch shot around the green. Sand wedges are typically more versatile and used out of sand traps as well as for higher lofting shots around the green. Lob wedges are generally used for shorter shots where the player requires a shot with very little run after the ball lands on the green.

Because wedges generally have multiple purposes and players use them differently, there are many options. One of the key options is the sole configuration. For example, F-grind sole configuration is a relatively planer sole having a small camber radius from front-to-back and from heel-to-toe. F-grind sole is an all-purpose grind that is particularly suited for full shots and shots hit with a square face. The grind is generally preferred by players that desire a traditional wedge sole.

The M-grind sole configuration has a relatively planar front portion surface that is crescent-shaped with large relief surface across the back, heel and toe portions of the sole. The M-grind is generally better for players with a shallower, more sweeping swing that play shots from a variety of clubface positions.

The S-grind sole configuration has a small camber radius from front-to-back and from heel-to-toe with some relief surface across the back portion of the sole. The S-grind sole is generally best for square faced shots like the F-grind, but has more versatility than the F-grind.

The D-grind sole configuration has a relatively planar front portion surface that is crescent-shaped and a large bounce angle with large relief surface across the back, heel and toe portions of the sole. The D-grind is generally preferred by players that have a steeper delivery to the ball because of the wedge's higher bounce. The D-grind is similar to the M-grind in that they have a crescent-shaped front portion of the sole, but the D-grind offers more bounce in the forward portion.

The K-grind sole configuration is high bounce wedge sole with a large camber radius from front-to-back and from heel-to-toe. The sole configuration is particularly useful for bunker shots. The K-grind is a wide, full sole wedge with enhanced camber to make it forgiving from a variety of sand and turf conditions.

The L-grind sole configuration features a narrow crescent shape front portion with steep relief surfaces along the back and at the heel and toe, allowing for maximum greenside versatility. The sole configuration is ideal for firm conditions and designed for skilled players who frequently open or close the clubface to create different types of shots around the green.

The bounce angle $\beta$ is the angle the sole creates with a planar ground surface when the hosel is in the vertical plane, a standard address position, as shown in FIG. 5. The bounce angle $\beta$ can also be measured by measuring the Face-to-Sole angle $\mu$ and subtracting the Face-to-Ground angle $\Omega$ (which is equivalent to $90°-\alpha$). Some wedges have a sole defined by a cambered surface from front-to-back. With these soles, the bounce angle $\beta$ can be determined from the tangent line of the curved surface half way between the leading edge and the trailing edge.

Figure 8:
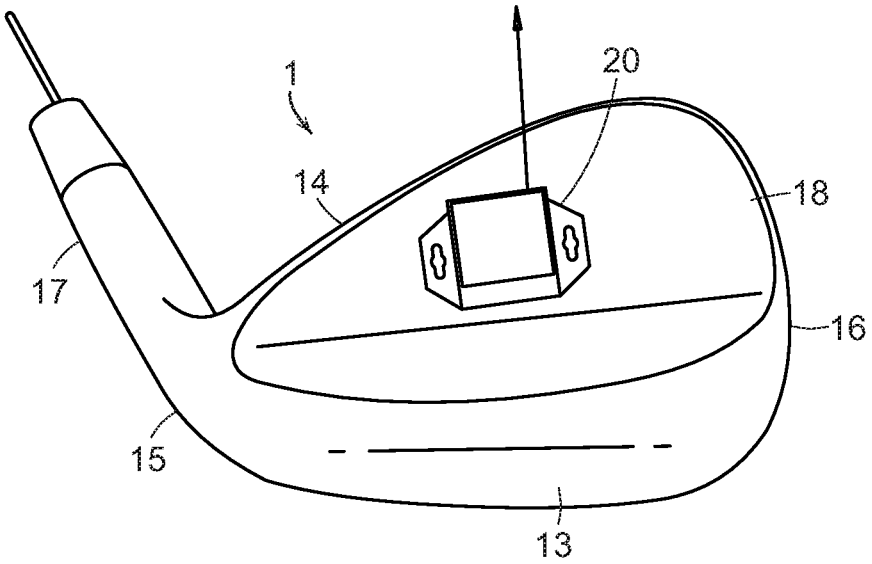
FIG. 8 illustrates a wedge with a sensor coupled to the back face.
Figure 9:
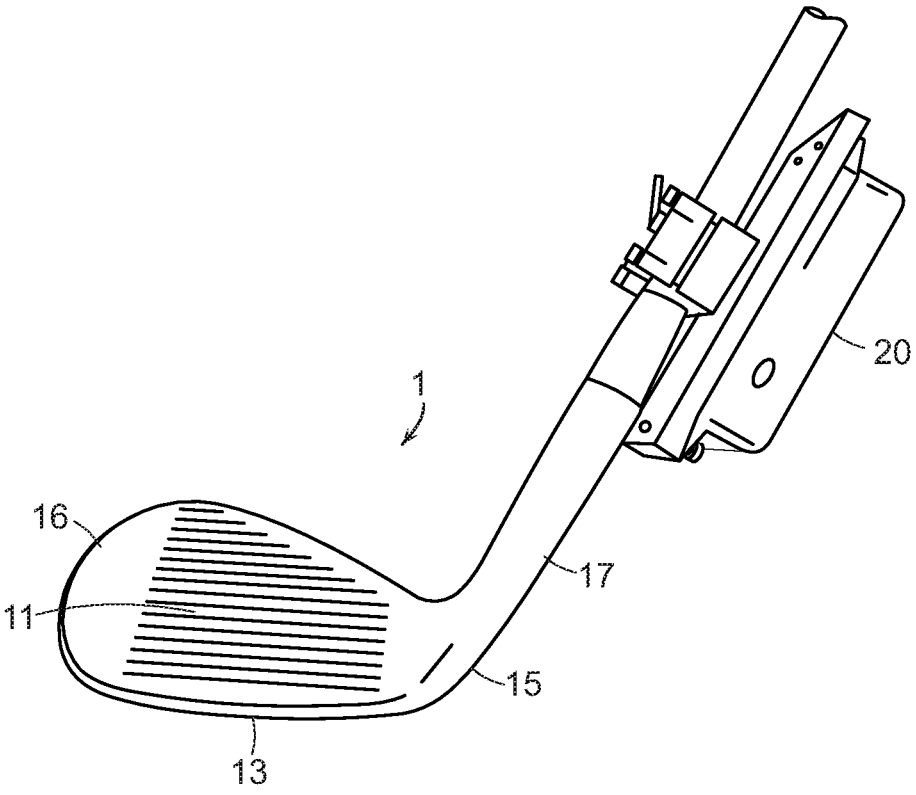
FIG. 9 illustrates a wedge with a sensor coupled to the lower shaft portion.

Referring to FIGS. 8 and 9, the system of fitting a golfer with the proper golf club includes a system and the related methods that enable a player to quantify the performance of the golf club's sole interaction with the ground and to determine the sole configuration and bounce angle that provides the most optimal shot performance. By improving the club impact, the player will inherently improve ball flight as well as control around the green.

The system of selecting the proper bounce and sole construction of a golf club head by measuring sole-to-ground impact forces includes a sensor 20 that is attached to the club 1 as shown in FIGS. 8 and 9. In FIG. 8, the club head 1 has a striking face on a forward portion of the body that is configured to strike a golf ball, and a back surface 18 of the body opposite said strike face. Extending from the strike face to the back wall on the bottom surface is a sole 13 that also extends from a heel side 15 of said body to a toe side 16 of said body. The body also incorporates a hosel 17 on the heel side of the body that is configured to receive a shaft 19. A sensor 20 is preferably attached to the back surface 18 of the club head 1.

In FIG. 9, the club head 1 has a striking face 11 on a forward portion of the body that is configured to strike a golf ball, and a back surface of the body opposite said strike face 11. Extending from the strike face to the back wall on the bottom surface is a sole that also extends from a heel side 15 of said body to a toe side 16 of said body. The body also incorporates a hosel 17 on the heel side of the body that is configured to receive a shaft 19. A sensor 20 is preferably attached to the shaft 19, adjacent to the hosel 17.

The sensor 20 is preferably a sensor that can measure acceleration and rotational velocity data as a function of time during a golf swing, such as accelerometers made by TEAC Corporation and Monnit The sensor 20 is coupled to a portion of the golf club and more preferably to the lower portion of the shaft 19, adjacent to the hosel 17, or the back surface 18 of the body. The sensor 20 provides acceleration and rotational velocity data to the computer, preferably through a Bluetooth communication. The sensor measures the response and deceleration of the golf club head during sole-to-ground impact, an event that lasts fractions of a second. The computer can calculate the power spectrum of the sensor as a function of frequency as shown in FIGS. 10-13, so that the impact of the sole with the ground surface can be analyzed to determine the most efficient interaction. A more efficient sole-to-ground interaction yields improved ball/club impact as well as optimized feel perception to the golfer.

The system preferably measures the power spectrum of the sensor for a range of about 0 Hz to about 300 Hz. The preferred sole configuration and bounce angle can be determined by those clubs exhibiting a power spectrum at 50 Hz being that is at least two times greater than the maximum power spectrum at frequencies between 100 Hz and 300 Hz. In the preferred system, the computer calculates a power spectrum difference, PSDIFF, which is the difference between a first power spectrum, PS1, at 50 Hz and a second power spectrum, PS2, that is the largest power spectrum data point measured between 100 Hz and 300 Hz. A player will try multiple golf club heads having similar lofts, that is within 2 degrees of each other, but that have different sole configurations such as those discussed above or different bounce angles or both. The club head that demonstrates the largest power spectrum difference PSDIFF has the most efficient club-to-ground impact and will provide optimal shot making capability and feel for that golfer.

For example, a player can test multiple lob wedges such as (1) a 58° loft, 10° bounce and S configuration sole, (2) a 60°, 8° bounce and M configuration sole and (3) a 60°, 12° bounce and D configuration sole. A sensor 20, that is attached to each of the wedges during the test swings, will provide the impact power spectrum to the computer and the club that exhibits the largest power spectrum difference can be selected as having the most efficient sole-to-ground impact.

Figure 10:
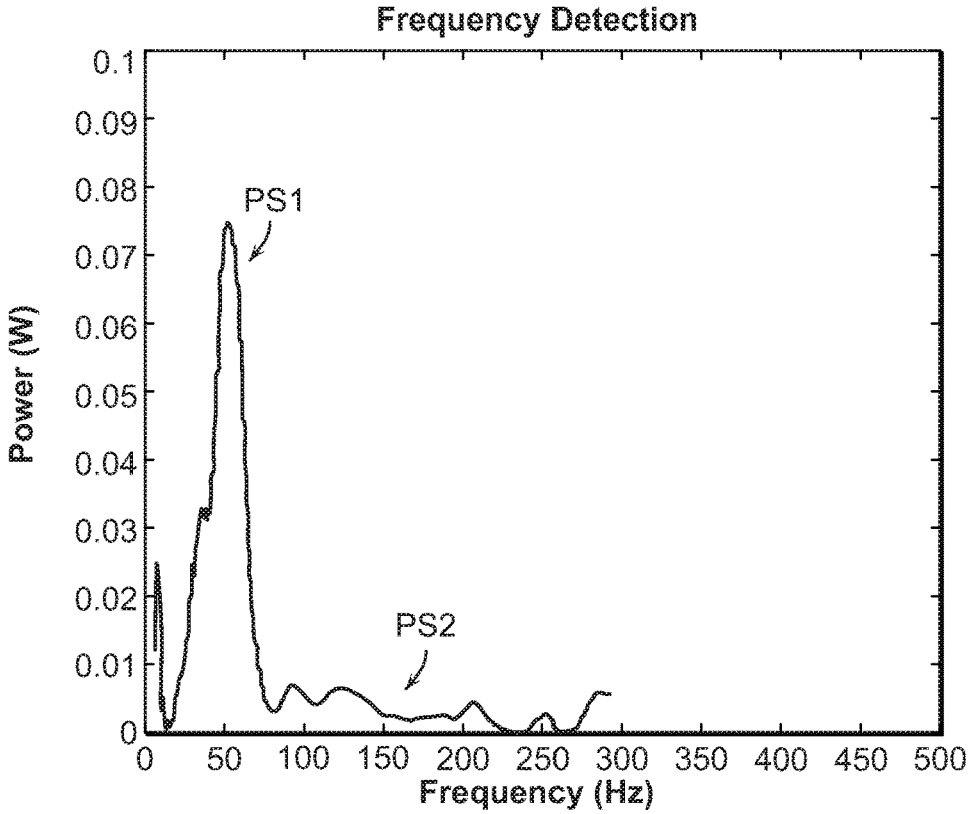
FIG. 10 illustrates the power spectrum of a sensor for an efficient impact.

Referring to FIG. 10, the first power spectrum PS1 at 50 Hz is approximately 0.07 W and the largest power spectrum between 100 Hz and 300 Hz, the second power spectrum PS2, is approximately 0.005 W. Thus, the power spectrum difference PSDIFF is about 0.065 W. This power spectrum distribution is representative of a good shot with efficient ground contact. The first power spectrum PS1 is high, but importantly, the second power spectrum PS2 is very low. There is very little feedback at the 100 HZ to 300 Hz frequencies.

Figure 11:
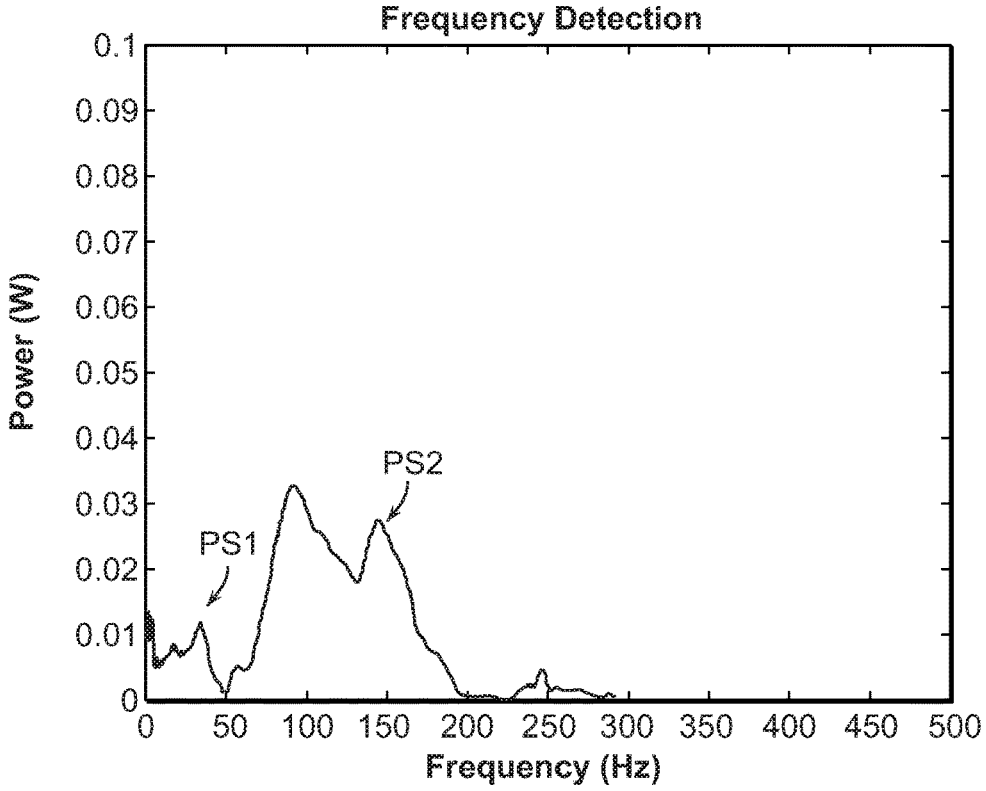
FIG. 11 illustrates the power spectrum of a sensor for a poor impact.

Referring to FIG. 11, the first power spectrum PS1 at 50 Hz is approximately 0.0 W and the largest power spectrum between 100 Hz and 300 Hz, the second power spectrum PS2, is approximately 0.03 W. Thus the power spectrum difference PSDIFF is negative and represents a very poor sole-to-ground interaction. This shot is very heavy in the sole-to-ground contact and the power spectrum from 100 Hz to 300 Hz is significant, i.e., it has two peaks of greater than 0.02 W. This power spectrum represents the poor contact and sole-to-ground impact.

Figure 12:
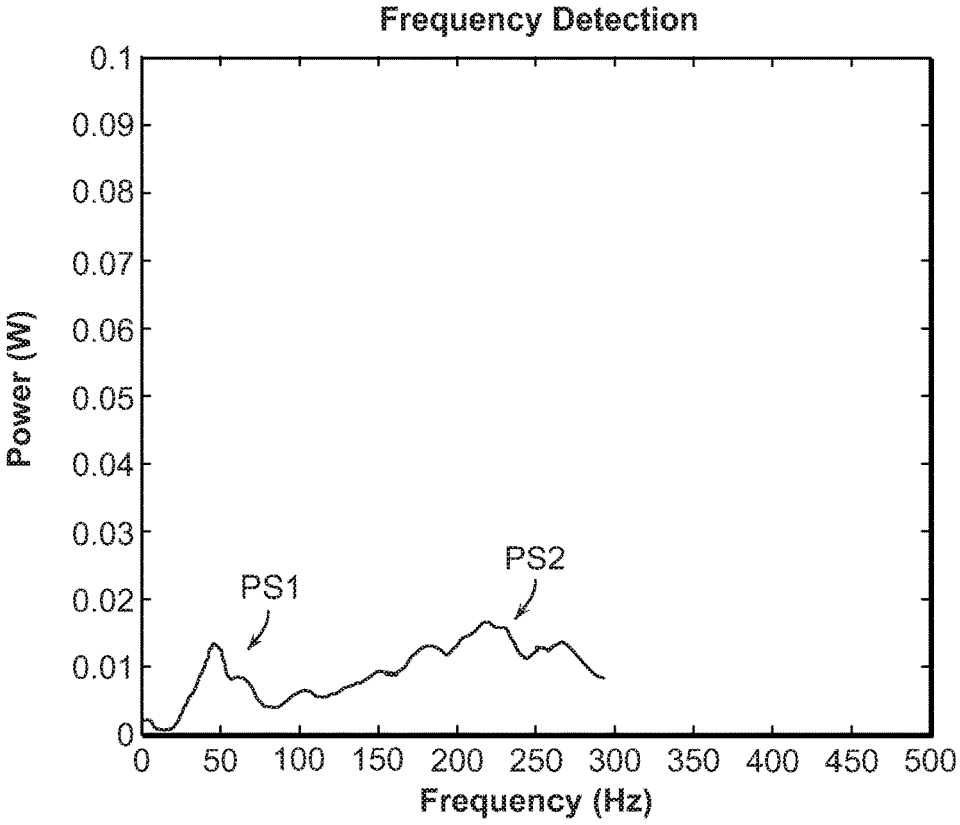
FIG. 12 illustrates the power spectrum of a sensor for a poor impact.

Referring to FIG. 12, the first power spectrum PS1 at 50 Hz is approximately 0.012 W and the largest power spectrum between 100 Hz and 300 Hz, the second power spectrum PS2, is approximately 0.017 W. Thus, the power spectrum difference PSDIFF is negative and represents a very poor sole-to-ground interaction. This shot is a thin shot with very little sole-to-ground contact and the power spectrum from 100 Hz to 300 Hz is not very significant, i.e., it has two peaks of less than 0.02 W. However, the first power spectrum PS1 is also extremely low, which represents the poor contact.

Figure 13:
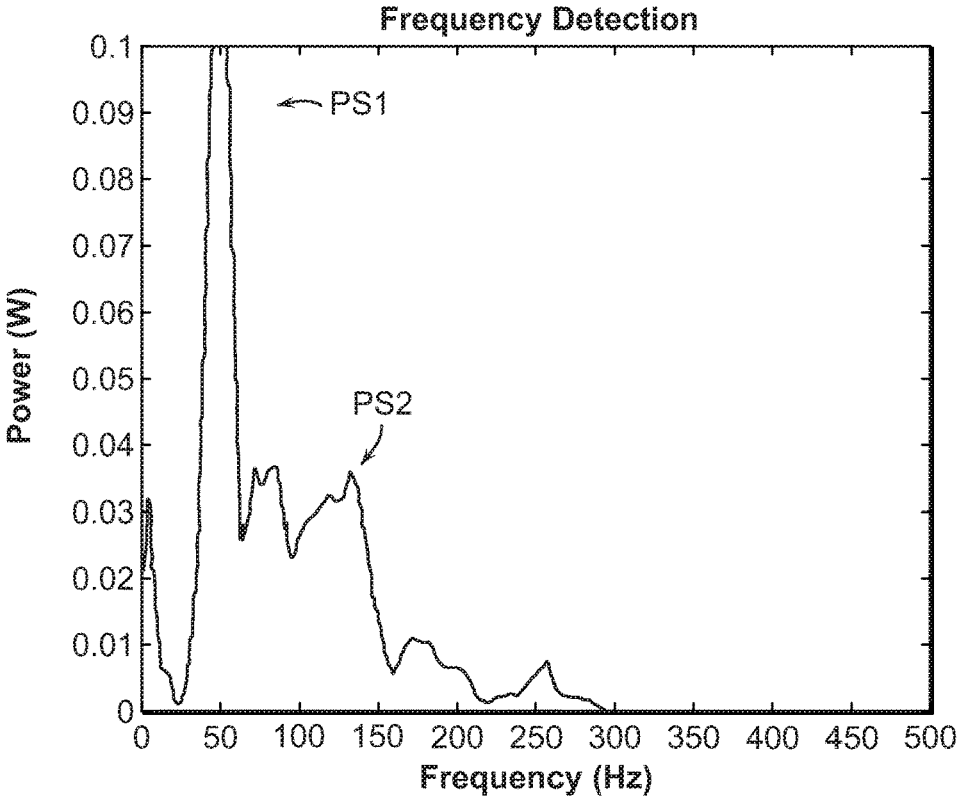
FIG. 13 illustrates the power spectrum of a less desirable impact.

Referring to FIG. 13, the first power spectrum PS1 at 50 Hz is approximately 0.11 W and the largest power spectrum between 100 Hz and 300 Hz, the second power spectrum PS2, is approximately 0.035 W. Thus, the power spectrum difference PSDIFF is large, greater than 0.05 W, but there is a significant second power spectrum PS2. This shot is not as bad as the shot represented by the power spectrums analyzed in FIG. 11. However, the contact with the ground was a little heavy as demonstrated by the power spectrum from 100 Hz to 300 Hz being more significant, i.e., it has two peaks of greater than 0.02 W. Thus, the PSDIFF demonstrated in FIG. 10 is better and the sole configuration and bounce angle of that club is the best fit for the player hitting the analyzed shots.

A similar system of selecting the proper bounce and sole construction of golf club head by measure impact according to the present invention preferably measures the power spectrum of the sensor for a range of about 0 Hz to about 300 Hz. The preferred sole configuration and bounce angle can be determined by those clubs exhibiting a power spectrum at 50 Hz being at least five times greater than the maximum power spectrum data point at all frequencies between 100 Hz and 300 Hz. In the preferred system, the computer calculates a power spectrum ratio PSR which is the ratio between a first power spectrum PS1 at 50 Hz and second power spectrum PS2 that is the largest power spectrum data point between 100 Hz and 300 Hz. The club head that demonstrates the largest power spectrum ratio PSR calculated for multiple golf club heads is the club head that has the most efficient club-to-ground impact and will provide optimal shot making capability.

Referring to FIGS. 10-13 again, the power spectrum ration PSR for the sole-to-ground impact in FIG. 10 is calculated as PSR=PS1/PS2. In this instance the PSR=0.07/0.005=14. This power spectrum ration is high, i.e., greater than 5 and represents an efficient impact. The power spectrum ration of the impacts represented in FIGS. 11 and 12 are both less than 1 and represent poor shots. The power spectrum ratio of the shot analyzed in FIG. 13 is approximately 3 (0.11/0.035). Thus, it is significantly better that the shots in FIGS. 11 and 12, but not as efficient as the shot analyzed in FIG. 10. Thus, the power spectrum ratio is preferably greater than about 2, more preferably greater than about 5, and most preferably greater than about 10, for the recommended club head having a particular sole configuration and bounce angle.

In yet another system of selecting the proper bounce and sole construction of golf club head by measuring impact according to the present invention preferably measures the power spectrum root mean square average, RMS, of the sensor for a frequency range of about 0 Hz to about 300 Hz. The preferred sole configuration and bounce angle can be determined by calculating a first power spectrum average RMS1 over a first frequency range of 0 Hz to 100 Hz and a second power spectrum average RMS2 for a second frequency range of 100 Hz to 300 Hz. The club head that demonstrates the largest power spectrum RMS average ratio over a preferred bandwidth, RMS1 (0-100 Hz)/RMS2 (100-300 Hz), for multiple golf club heads is the club head that has the most efficient club-to-ground impact and will provide optimal shot making capability. Preferably, the power spectrum RMS ratio is greater than 1, and more preferably, greater than about 1.5 for the preferred club head.

The present invention is also directed to a method of fitting a golfer with a golf club having the proper bounce and sole construction of golf club head by measuring impact forces of the sole-to-ground interaction. The method includes the providing a plurality of golf club heads, each of the club heads having a sole configuration and bounce angle combination, attaching a sensor to the golf club heads, having the golfer hit predetermined golf shots with the golf club heads, recording the sensor's power spectrum from about 0 Hz to about 300 Hz, measuring a first power spectrum data point at 50 Hz and a second power spectrum data point that is a maximum power spectrum between 100 Hz and 300 Hz, calculating a power spectrum difference, PSDIFF, for each club by subtracting the second power spectrum data point from the first power spectrum data point, and selecting a preferred club having a particular sole configuration and bounce angle from the plurality of clubs that demonstrates the largest power spectrum difference.

The present invention is also directed to a method of fitting a golfer with a golf club having the proper bounce and sole construction of golf club head by measuring impact forces of the sole-to-ground interaction. The method includes the providing a plurality of golf club heads, each of the club heads having a sole configuration and bounce angle combination, attaching a sensor to the golf club heads, having the golfer hit predetermined golf shots with the golf club heads, recording the sensor's power spectrum from about 0 Hz to about 300 Hz, measuring a first power spectrum data point at 50 Hz and a second power spectrum data point that is a maximum power spectrum between 100 Hz and 300 Hz, calculating a power spectrum ratio, PSR, for each club by dividing the first power spectrum data point by the second power spectrum data point, and selecting a preferred club having a particular sole configuration and bounce angle from the plurality of clubs that demonstrates the largest power spectrum ratio.

Figure 14:
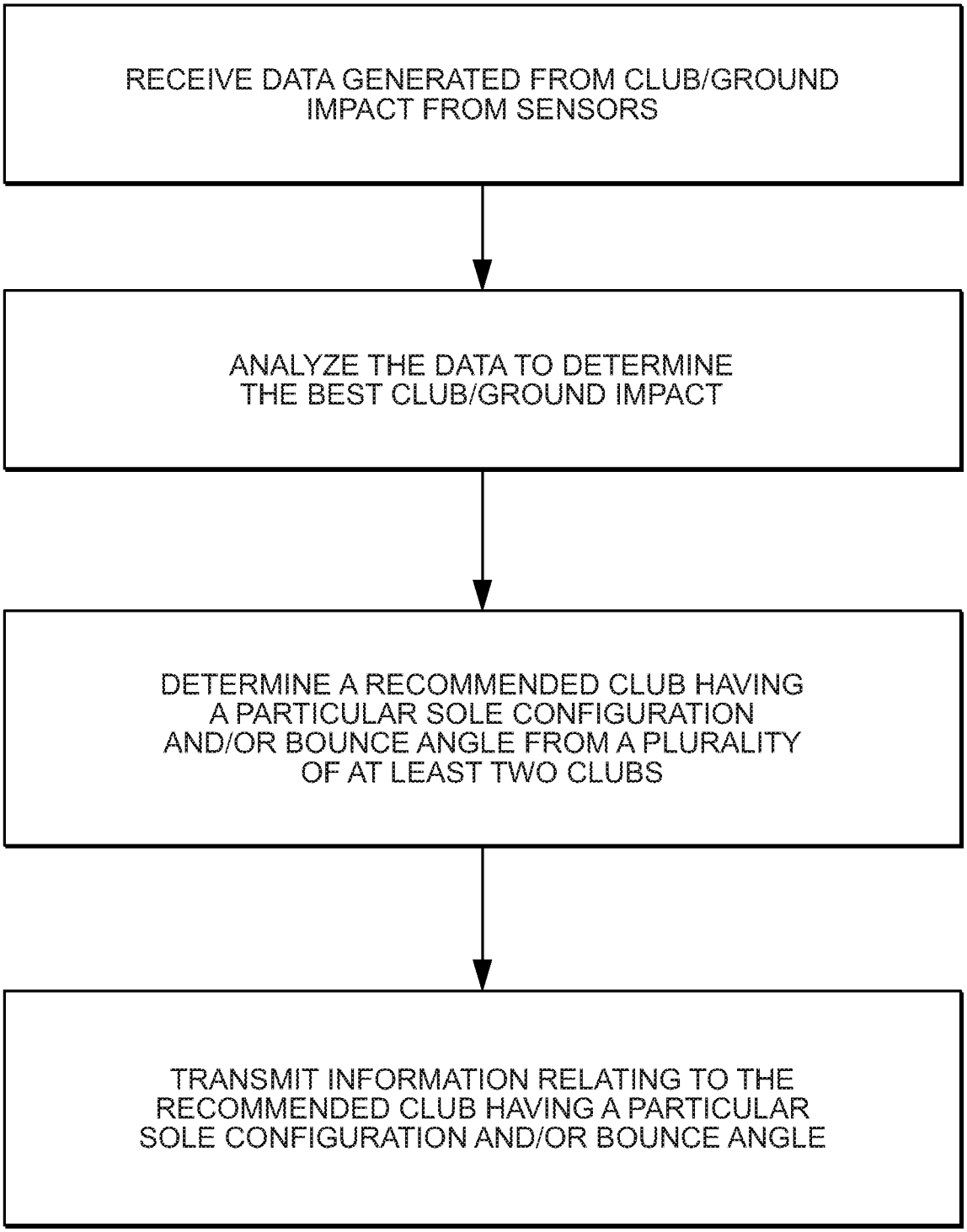
FIG. 14 illustrates a flow chart of a preferred method of fitting golf clubs.

Now referring to FIG. 14, a flowchart diagram illustrates a preferred method of fitting golf clubs, and more particularly, the systems and methods related to wedge type golf clubs, having multiple sole configurations and/or bounce angles. The approach and technique indicated by the flowchart are sufficient to describe at least one implementation of the present method. However, other implementations of the method may utilize approaches and techniques different from those shown.

The method outlined in the flowchart includes receiving data generated from the sensor 20 of the club impact with the ground during the golf swing. Preferably, the acceleration and rotational velocity data from the sensor is transmitted to a computer or network, as discussed in more detail below, through a Bluetooth communication.

After the data is received, the method includes analyzing the data to determine the most efficient sole-to-ground impact. Preferably, the method includes analyzing the power spectrum of the sensor as a function of frequency as shown in FIGS. 10-13 above. The system preferably measures the power spectrum of the sensor for a frequency range of about 0 Hz to about 300 Hz. Then, an algorithm analyzes the impact of the sole with a ground surface data for multiple shots to determine the power spectrum difference, PSDIFF, and/or the power spectrum ratio, PSR, as discussed above, for each shot.

After the data has been analyzed, the preferred sole configuration and bounce angle having the most efficient sole-to-ground interaction from the plurality of club configurations can be determined. The step of recommending a club having a particular sole configuration and/or bounce angle can include identifying the club specifications exhibiting the best PSDIFF and/or PSR from the power spectrum analysis. The data is from the multiple golf club heads having similar lofts but that having different sole configurations such as those discussed above or different bounce angles or both. The club head that demonstrates the largest power spectrum difference or greatest power spectrum ratio has the most efficient club-to-ground impact and will provide optimal shot making capability and the best perceived feel for that golfer. In another embodiment of the invention, the computer can recommend a club head having a particular sole configuration and/or bounce angle that was not hit by the golfer. In analyzing the data and comparing the data with past data, it can be determined that a particular club head configuration that was not tested by the golfer will be better than those tested. The recommendation engine may determine at least one of the golf clubs from a database of club heads based on information between the PSDIFF and/or the PSR of the club heads tested and others in the database that were not tested. In other words, the recommendation engine may utilize other factors or parameters to determine the recommended club head.

Finally, the method outlined in the flowchart includes transmitting information relating to the recommended club. For example, the computing device may transmit the information relating to the recommended golf club to a display of the computing device. The information pertaining to the recommended golf club may include the model, loft, sole configuration and bounce angle. Additionally, the computer may recommend the shaft model and flex and grip. In another example, if a server is completing the analysis and recommendation, it may transmit the information pertaining to the recommended golf club over a network to a computing device, for rendering on the display of the computing device.

Figure 15:
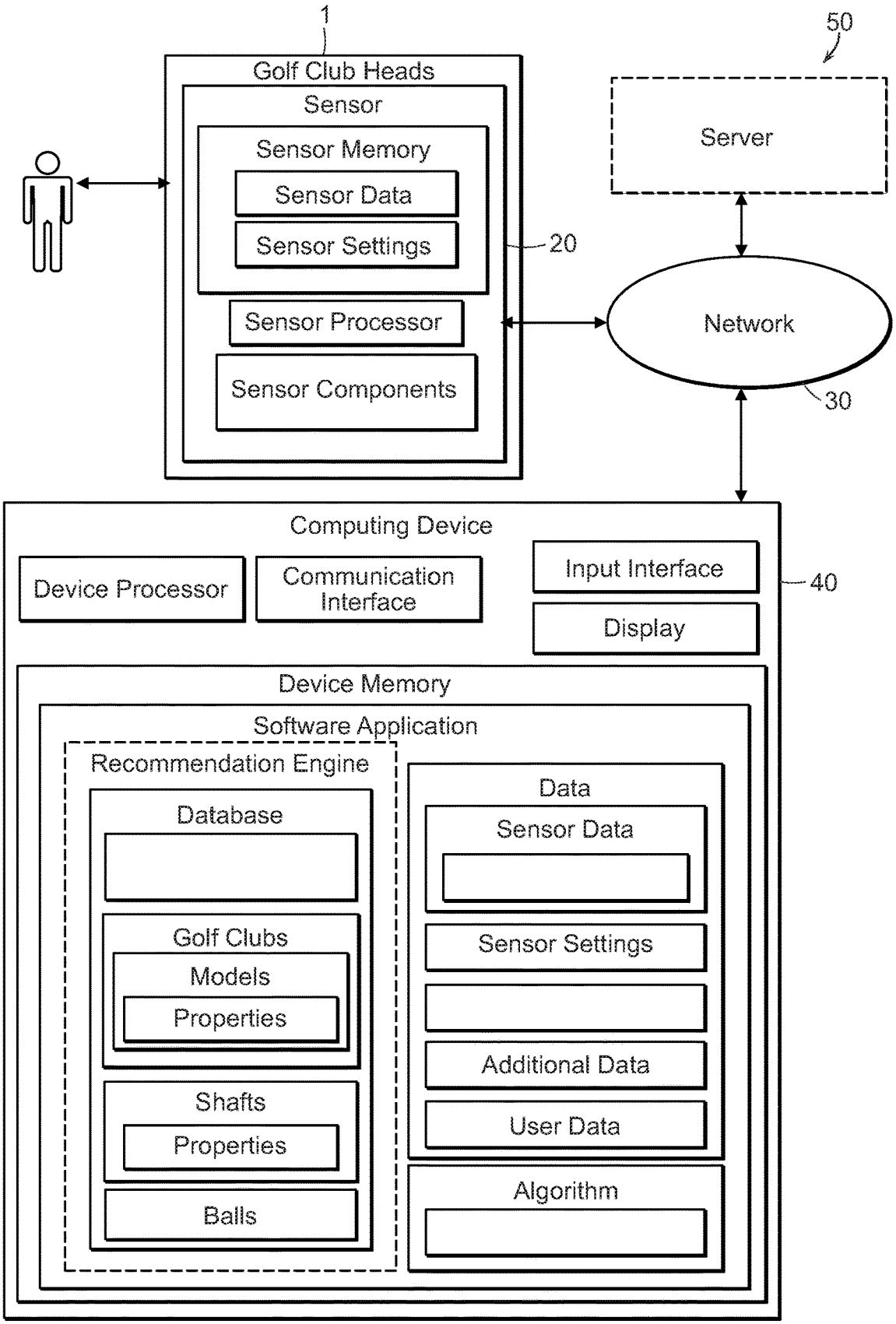
FIG. 15 illustrates a diagram of a system for fitting golf clubs.
Figure 16:
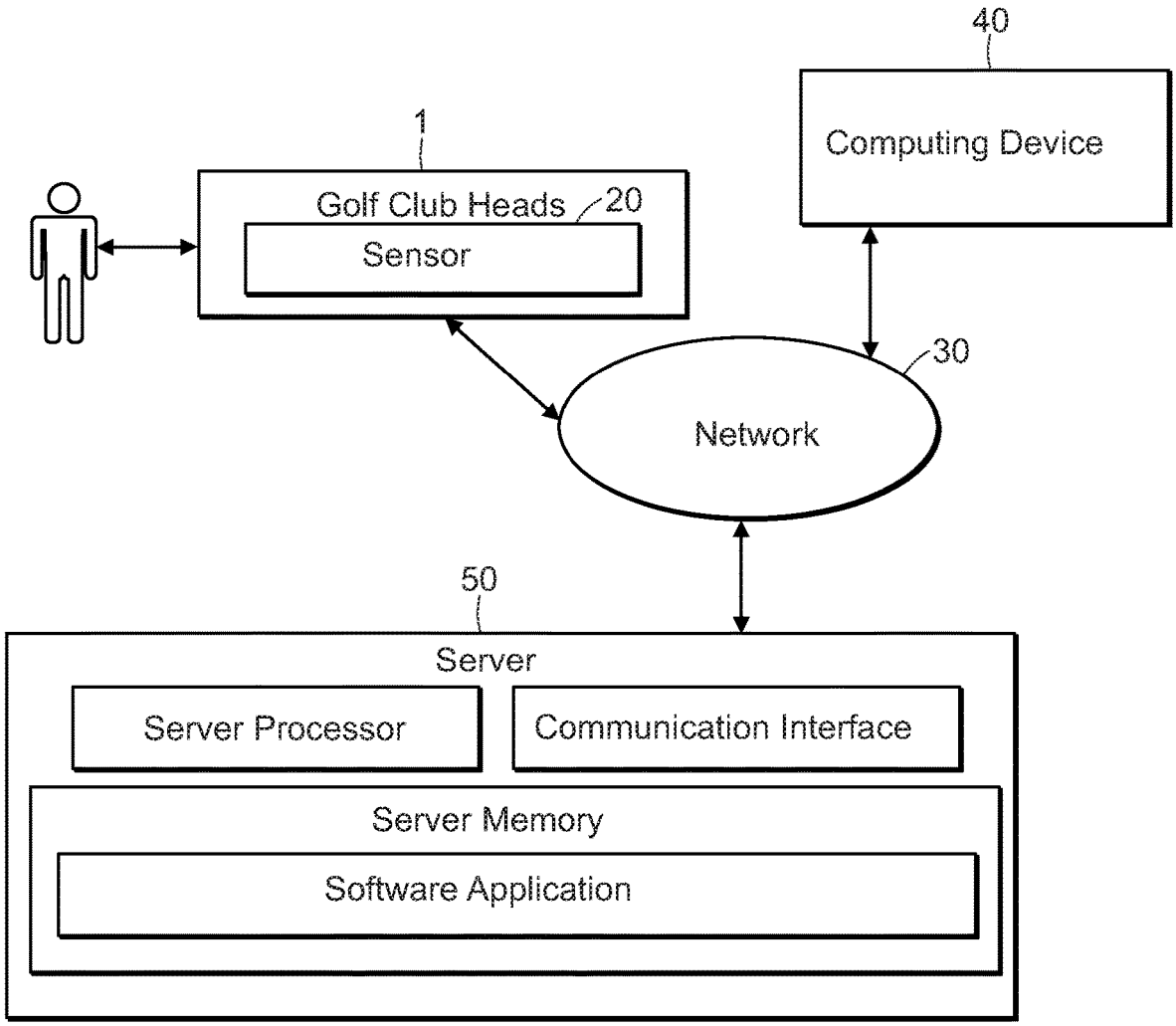
FIG. 16 illustrates a diagram of a system for fitting golf clubs.

Referring now to FIGS. 15 and 16, the system for fitting a golf club includes a plurality of golf clubs 1 with sensors 20 and a computing device 40. As stated above, the golf clubs are preferably wedge type irons that have different sole configurations and/or bounce angles.

A network 30 can be used to enable communication between sensors 20, computing device 40, and a server 50. Although network 30 is illustrated as being a single network, the illustration of FIGS. 15 and 16 are not intended to limit the scope of the disclosure. As such, the network 30 may include a wireless network or any number of networks in communication with each other, and/or any number of separate networks not in communication. Further, the sensors 20 can communicate with the computing device 40 via a Bluetooth or similar connection so that data can be transferred directly between the two devices. The computing device 40 can then be coupled to a server 50 through a network 30 or the like if data from the server 50 is required.

The computing device 40 is configured to receive data from the sensors 20. The computing device 40 may be a mobile device, a tablet computer, a laptop computer, a wearable device, such as a smart watch, or desktop computer, or any other suitable device capable of receiving and/or transmitting data and operating a software program. Although the computing device 40 is illustrated as being a single computing device, the illustration of FIGS. 15 and 16 are not meant to limit the scope of the disclosure. In some implementations, there may be any number of computing devices in communication with the sensors 20 or with each other and/or a network 30.

The sensors 20 are configured to generate and transmit data relating to impact of the reference golf club 1 and the ground during a swing by the player. As stated above, the sensors 20 may be attached externally, to lower portion of the shaft adjacent the hosel or directly to the back surface of the club head itself. The sensors 20 may be attached to or inserted within the shaft and/or the club head of the reference golf club 1 using clamping mechanisms, adhesive, plugs, mechanical fasteners, or another suitable method capable of holding the sensors 20 in place during a full swing of the reference golf club 1.

The computing device 40 can receive the data from the sensors 20 and use a software application to calculate the efficiency of the impact. Preferably, the computing device 40 determines the power spectrum versus frequency, and more preferably, the power spectrum difference and/or the power spectrum ratio. Preferably, the computing device 40 can display the data for validation to the player and can store the data and information pertaining to the club head, shafts and ball used. Further the computing device 40 and/or the server 50 may receive further data from a launch monitor or the like and use that data to further refine the recommendation of the club head to include shaft specifications and/or a ball type that will further assist the player's game.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A system of selecting the proper bounce angle and sole construction of golf club head by measuring sole-ground impact forces, comprising: a plurality of golf club heads, each of the heads having similar loft and a different sole configuration and bounce angle combination:

each head of said plurality of heads having a golf club body, said body comprising:

a striking face on a forward portion of said body, said striking face configured to strike a golf ball, and a back surface of said body opposite said strike face;

a sole on a bottom portion of said body that extends from a heel side of said body to a toe side of said body;

a top line on a top portion of said body;

a hosel configured to receive a shaft, said hosel located on the heel side of said body;

wherein said striking face comprises a plurality of grooves formed therein;

wherein said sole has a first configuration selected from a plurality of configurations and the bounce angle of between about 5° and 20°;

wherein said system further comprises a sensor that can measure acceleration and rotational velocity data as a function of time during a golf swing, the sensor being coupled to a lower portion of the shaft or the body and being in communication with a computing device to provide said acceleration and rotational velocity data to said computing device;

wherein the computer can determine the efficiency of the impact of the sole with a ground surface.

2. The system of selecting the proper bounce angle and sole construction of golf club head by measure impact forces of claim 1, wherein said computing device computes a power spectrum of the sensor for a frequency range of about 0 Hz to about 300 Hz.

3. The system of selecting the proper bounce angle and sole construction of golf club head by measure impact forces of claim 2, wherein said proper sole configuration and bounce angle are determined by a power spectrum at 50 Hz being at least two times greater than the maximum power spectrum peak for frequencies between 100 Hz and 300 Hz.

4. The system of selecting the proper bounce angle and sole construction of golf club head by measure impact forces of claim 2, wherein said computing device calculates a power spectrum difference which is the difference between a first power spectrum at 50 Hz and second power spectrum that is the largest power spectrum data point between 100 Hz and 300 Hz.

5. The system of selecting the proper bounce angle and sole construction of golf club head by measuring impact forces of claim 4, wherein computing device selects a sole configuration and a bounce angle for a player that represents the largest power spectrum difference calculated for multiple golf club heads.

6. The system of selecting the proper bounce angle and sole construction of golf club head by measure impact forces of claim 2, wherein said computing device calculates a power spectrum ratio which is the ratio of a first power spectrum at 50 Hz and second power spectrum that is the largest power spectrum data point between 100 Hz and 300 Hz.

7. The system of selecting the proper bounce angle and sole construction of golf club head by measuring impact forces of claim 6, wherein computing device selects a sole configuration and a bounce angle for a player that represents the largest power spectrum ratio calculated for multiple golf club heads.

8. The system of selecting the proper bounce angle and sole construction of golf club head by measure impact forces of claim 2, wherein said computing device calculates a power spectrum root mean square average ratio which is the ratio between a first power spectrum root mean square average for a first frequency range of 0 Hz to 100 Hz and second power spectrum root mean square average for a second frequency range of 100 Hz to 300 Hz.

9. The system of selecting the proper bounce angle and sole construction of golf club head by measuring impact forces of claim 8, wherein computing device selects a sole configuration and a bounce angle for a player that represents the largest power spectrum root mean average ratio calculated for multiple golf club heads.

10. A method of fitting a golfer with a golf club having the proper bounce angle and sole configuration by measuring impact forces, comprising:

providing a plurality of golf club heads, each of the club heads having similar loft and a different sole configuration and bounce angle combination;

attaching a sensor to the golf club heads;

having the golfer hit predetermined golf shots with the golf club heads;

recording the sensors' power spectrum from about 0 Hz to about 300 Hz;

measuring a first power spectrum data point at 50 Hz and a second power spectrum data point that is a maximum power spectrum between 100 Hz and 300 Hz for each of the golf shots;

calculating a power spectrum difference for each club by subtracting the second power spectrum data point from the first power spectrum data point or calculating a power spectrum ratio for each club by dividing the first power spectrum data point by the second power spectrum data point; and selecting a preferred club from the plurality of clubs that demonstrates the largest power spectrum difference or the greatest power spectrum ratio.

11. A method of fitting a golfer with a golf club having the proper bounce angle and sole configuration by measuring impact forces, comprising:

providing a plurality of golf club heads, each of the club heads having similar loft and a different sole configuration and bounce angle combination;

attaching a sensor to the golf club heads;

having the golfer hit predetermined golf shots with the golf club heads;

recording the sensors' power spectrum from about 0 Hz to about 300 Hz;

measuring a first power spectrum root mean average for a frequency range of 0 Hz to 100 Hz and a second power spectrum root mean square average for a second frequency range of 100 Hz to 300 Hz for each of the golf shots;

calculating a power spectrum root mean square average ratio for each club by dividing the first power spectrum root mean square average by the second power spectrum root mean square average; and selecting a preferred club from the plurality of clubs that demonstrates the largest power spectrum root mean square average ratio.

* * * * *